US005178562A

United States Patent [19]

Ermini

[11] Patent Number: 5,178,562

[45] Date of Patent: Jan. 12, 1993

[54] CONTACT MEMBER FOR MINIATURE ELECTRICAL CIRCUIT CONNECTOR

[75] Inventor: George F. Ermini, Milwaukie, Oreg.

[73] Assignee: Epson Portland, Inc., Portland, Oreg.

[21] Appl. No.: 779,422

[22] Filed: Oct. 17, 1991

[51] Int. Cl.[5] ..... H01R 13/648

[52] U.S. Cl. ..... 439/609; 439/149

[58] Field of Search ..... 439/92, 101, 108, 135, 439/607, 608, 609, 149, 610, 148; 174/138 F

[56] References Cited

U.S. PATENT DOCUMENTS

| | | | |
|---|---|---|---|
| 4,493,525 | 1/1985 | Hall et al. . | |
| 4,629,268 | 12/1986 | Hiles | 439/136 |
| 4,637,669 | 1/1987 | Tajima . | |
| 4,708,412 | 11/1987 | Himes, Jr. et al. | 439/607 X |
| 4,821,145 | 4/1989 | Corfits et al. | 439/607 X |
| 4,842,554 | 6/1989 | Cosmos et al. . | |
| 4,842,555 | 6/1989 | Cosmos et al. . | |
| 4,913,664 | 4/1990 | Dixon et al. . | |
| 4,925,405 | 5/1990 | Wei . | |
| 4,943,244 | 7/1990 | Teck et al. | 439/607 X |
| 5,022,871 | 6/1991 | Sekiguchi | 439/609 |
| 5,026,295 | 6/1991 | Fong et al. | 439/148 X |

*Primary Examiner*—Larry I. Schwartz

*Assistant Examiner*—Khiem Nguyen

*Attorney, Agent, or Firm*—W. Douglas Carothers, Jr.

[57] ABSTRACT

An electronic apparatus, such as, in the form of a computer having an electrical circuit motherboard upon which is mounted, inter alia, a microprocessor and memory for use in conjunction with the operation of said computer, the circuit board is mounted in an electrical chassis that has at least one side wall, such as, a backplane, adjacent to one edge of the mounted circuit board. At least one miniature electrical circuit connector is mounted along an edge of the circuit board and has a body with a front face including an electrical receptacle aligned with an aperture in formed in the backplane. A conductive shield is formed over a portion of the connector body including its front face with an aperture formed in the shield front face to permit exposure of receptacle through the backplane aperture. A resilient conductive contact member is connected to said connector and the connector conductive shield and extends or protrudes outward from the body front face of the connector for biased engagement against the backplane when the circuit board is so mounted within the electrical chassis. The resilient conductive contact member may take several different forms.

24 Claims, 6 Drawing Sheets

CONTACT MEMBER FOR MINIATURE ELECTRICAL CIRCUIT CONNECTOR

BACKGROUND OF THE INVENTION

This invention relates generally to miniature electrical circuit connectors and more particularly to miniature DIN connectors or receptacles, so called "mini DIN's", and specifically to means for effective electrical grounding of such connectors.

ECB miniature DIN connectors are well known in the art and are exemplified in U.S. Pat. Nos. 4,842,554; 4,842,555; 4,925,405; 4,493,525; 4,925,405; 4,913,664; and 4,637,669. These connectors are standard electrical plug compatible connectors used by manufacturers to provide for connection of electrical equipment, such as, computers, audio or video equipment, to one another and to peripheral components. One basic utility today for such connectors is connection of mouse cursor devices to computers. The conventional mini DIN connector is circuit board mountable and includes terminals with solder tails or surface mountable contacts for making appropriate electrical connections to conductive receiving portions of a circuit board.

Further, government agencies and authorities require strict compliance to EMI standards to ensure that electromagnetic energy is maintained to an approved level. The conventional manner of controlling EMI is the use of a metal member that covers and surrounds the connector terminals mounted within the plastic body of the mini DIN connector and is grounded to the circuit board on which the connector is mounted. The forward end of the connector containing the plug receptacle is exposed through an aperture provided in the grounding shield. These shields are designed to suppress undesired levels of EMI generated from electrical components in the immediate region of the mounted mini DIN connector.

Many types of electrical equipment which employ mini DIN connectors mounted along the rear edge of a horizontally mounted circuit board in a chassis, such as a main circuit or mother board of a computer or other such equipment. Openings are provided in a rear vertical panel or backplane of the equipment for receiving an external plug in the connector receptacle through an aperture in the backplane. The backplane also function as ground planes that also aid in the suppression of EMI. Thus, it is desirable to electrically ground the backplane to the EMI shield of the mini DIN connector. This, however, is not an easy task since the mini DIN connectors are mounted on the mother board and the vertical backplane is a separate component and assembled into the equipment differently and separately from the mother board. This makes it difficult to ground the mini DIN connector shield to the backplane as there is a multitude of tolerance differences from chassis to chassis. The issue is, then, how can this electrical ground connection between the mini DIN ground and the backplane be accomplished in a simple assembled and maintained manner.

One manner employed in making this electrical secured contact between the mini DIN connector and the backplane is the use of a mechanical connection in the form of a sheet metal screw for securing the mini DIN EMI shield through an extension thereof directly to the surface of the backplane. Not only does this require extra parts but also is an additional task to complete the necessary connection of one or more mini DIN type connectors to the backplane after these latter components have been assembled and soldered into the main circuit board. Further, disassembly for repair or maintenance is hampered by the necessity of, first, disconnecting the main circuit board mini DIN connectors from the backplane before removal of the main circuit board can be removed from the equipment chassis.

Furthermore, the standard mini DIN connector design utilized today can not withstand subjection to a solder bath with the component mounted circuit board because they are not flow solderable and the electrical terminals provided in the apertures of the connector are easily contaminated by solder flux thereby affecting good connectability.

It is an object of the present invention to provide a means for achieving and maintaining sustained electrical contact between a mini DIN connector ground shield and a ground backplane without the need for a fastened or mechanical connection.

It is another object of this invention to provide a mini DIN structure that can be subjected to a solder bath, as connected to a circuit board without contamination of the mini DIN socket or receptacle from exposure to solder flux.

SUMMARY OF THE INVENTION

According to this invention, a conductive contact member is provided relative to the front face of a miniature electrical circuit connector or mini DIN connector to make engaged and maintained electrical contact with the conductive side wall or backplane of the chassis of electronic equipment or apparatus, such as a computer, when the circuit board upon which such connectors are mounted are inserted and set into the equipment chassis. The contact member may be a separate member or formed as an integral part of the conductive external shield for EMI shielding that surrounds the several external sides of the housing or body unit of the mini DIN connector. In the typical environment, mini DIN connectors are mounted along the rear edge of a main circuit board or mother board of an electronic apparatus, such as a computer, so that the face of the circular receptacle of the mini DIN connector will be exposed through the backplane when the motherboard is mounted into the electrical chassis of the electronic apparatus. The contact member is provided with conductive extending portions that engage the surface of the conductive backplane and are biased, such as, by being spring loaded, against the surface of the backplane to maintain continuous and sustained grounding connection between the motherboard ground or EMI shielding and the backplane.

Thus, according to this invention, electronic apparatus, such as, in the form of a computer having an electrical circuit board upon which is mounted a microprocessor and memory for use in conjunction with the operation of said computer, the circuit board is mounted in an electrical chassis that has at least one side wall, such as, a backplane, adjacent to one edge of the mounted circuit board. At least one miniature electrical circuit connector is mounted along an edge of the circuit board and has a body with a front face including an electrical receptacle aligned with an aperture formed in the backplane. A conductive shield is formed over a portion of the connector body including its front face with an aperture formed in the shield front face to permit exposure of receptacle through the backplane aperture. A resilient conductive contact member is connected to said connector and the connector conductive shield and extends or protrudes outward from the body front face of the connector for biased engagement against the backplane when the circuit board is so mounted within the electrical chassis. The resilient conductive contact member can take several forms. In a first form, the contact member extends directly from the front face of the connector and functions as a spring member to pressure engage against the backplane when the circuit board is mounted within the electrical chassis.

In a second form, the contact member has a wall surface extending in front of the connector front face with an aperture formed in the contact member wall surface substantially aligned or concentric with the shield aperture, and resilient means is formed on the contact member surface for biased engage against the backplane when the circuit board is mounted within the electrical chassis. Further, the contact member wall surface is connected to a bifurcated foot portion at substantially right angle relationship. The conductive shield of the connector has downwardly extending connection lugs for mounting the connector to the circuit board permitting the conductive shield to be grounded to the board. Means in the form, for example, of apertures or cutout portions in the bifurcated foot portion receive the shield connection lugs to secure the contact member firmly between the connector and the circuit board when the connection lugs of the connector are mounted to the circuit board. Also, resilient spring members may be formed to extend upwardly from bifurcated foot portion for biased engagement against the connector shield formed on side surfaces of the connector body when the contact member is slipped onto the shield connection lugs and these assembled parts are mounted to the circuit board.

In a third form, the contact member is secured to the base of the connector shield and has upward extending wall portion with an aperture formed in the contact member wall portion substantially aligned with the shield aperture, and resilient means formed along the side edges of the contact member side wall are biased engaged against the backplane when the circuit board is mounted within the electrical chassis.

In a fourth form, the contact member extends from the front face of the connector from the front face shield surface and is in the form of a wavy washer to function as a bias member for pressure engagement against the backplane when the circuit board is mounted within the electrical chassis.

In another embodiment, the receptacle of the miniature electrical circuit connector may be provided with an extended barrel from the front face surface of the connector body to permit its extension through the aperture in the backplane of side wall surface. This extend receptacle also provides an additional function during manufacture of being able to be covered and protected by an elastomeric cot or condom when the miniature electrical circuit connector is mounted to the electrical board so that the cot or condom protects the receptacle from solder flux applied to the electrical board prior to subjecting the board to a solder bath.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
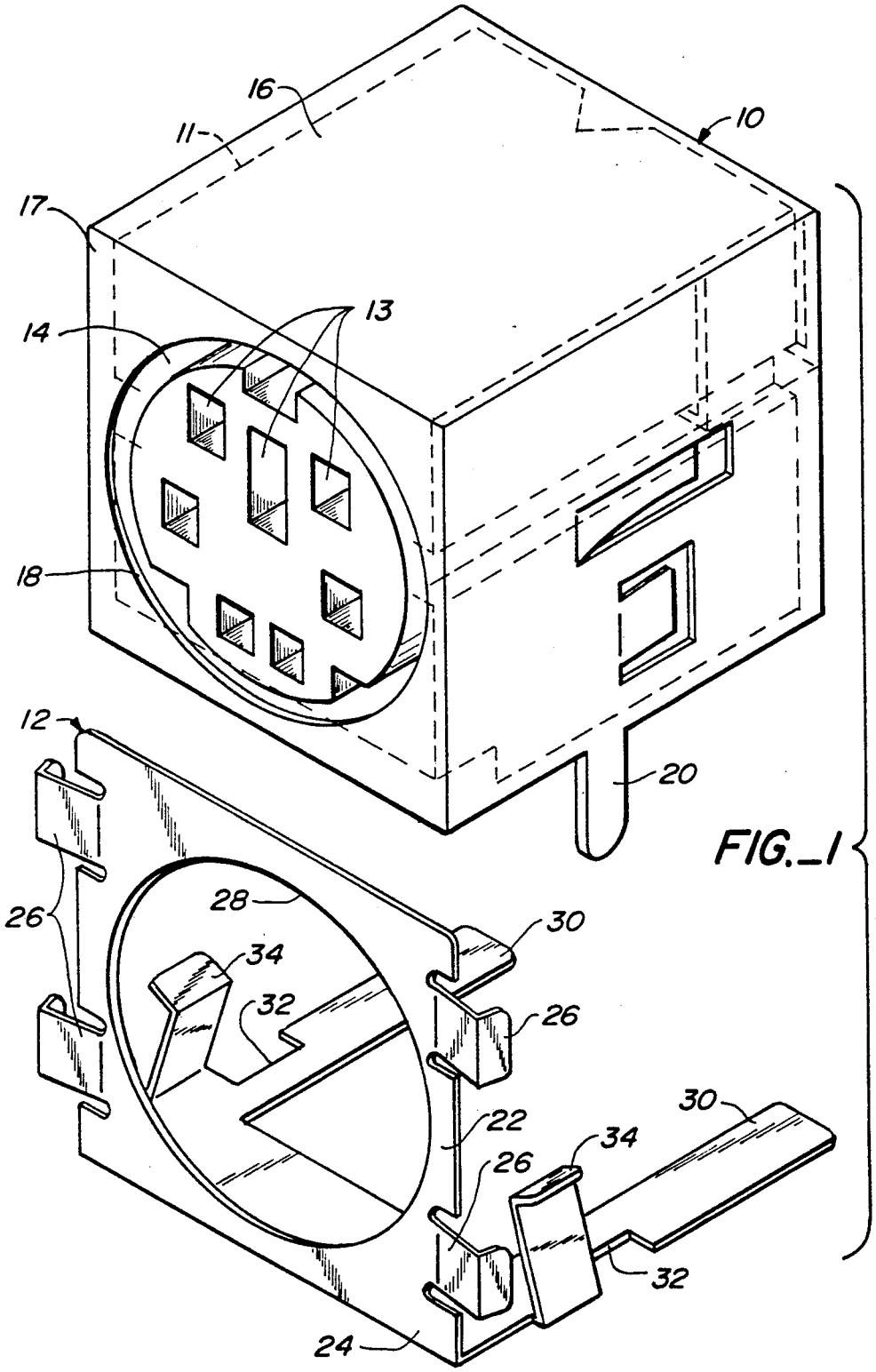
FIG. 1 is a perspective view of a first embodiment of a ground contact mount for a miniature electrical circuit connector comprising this invention.
Figure 3:
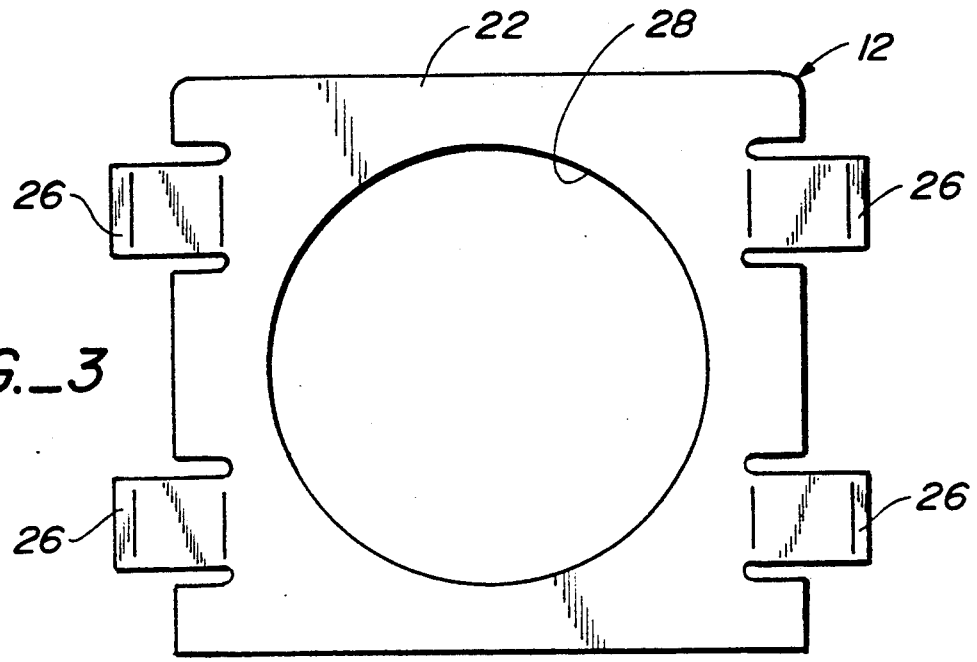
FIG. 3 is a front elevation of the ground contact mount of FIG. 1.

Reference is now made to various embodiments illustrating this invention. In the first embodiment of FIGS. 1–3, there is shown a first embodiment of this invention comprising miniature electrical circuit connector 10 and resilient conductive contact means in the form of contact member 12. Miniature connector 10 is a standard mini DIN connector known in the art and are illustrated in the previously listed U.S. patent references. Connector 10 has an insulating body 11 including on its front face surface receptacle 14 having a plurality of apertures 13 for receiving the pin-receiving contact portions of electrically conductive terminals (not shown). These terminals include downwardly depending solder tails 21 (FIG. 6) for connection to other circuit components on the circuit board. A conductive external EMI shield 16 covers the several sides of the connector body and has an aperture 18 formed in its front face 17 to permit the exposure of receptacle 14. In some embodiments of mini DIN connectors, a cylindrically shaped or annular internal EMI shield is provided around the pin-receiving contact portions. External shield 16 includes a pair of downwardly extending lugs 20 for connecting connector 10 to a circuit board.

Figure 2:
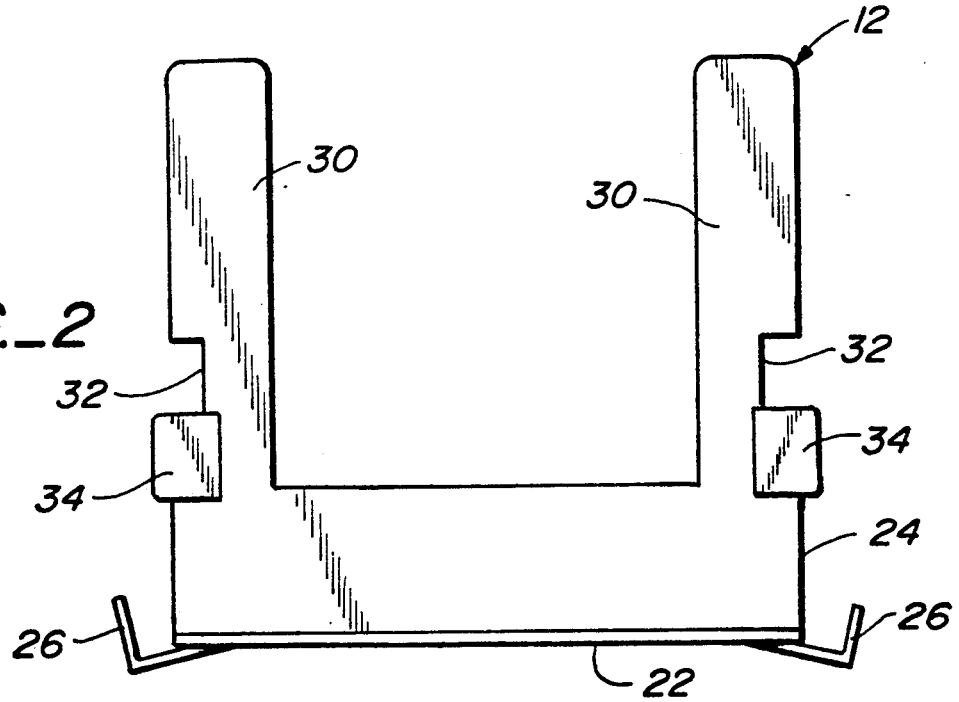
FIG. 2 is a top view of the ground contact mount of FIG. 1.

Contact member 12 comprises an upstanding wall section 22 which is connected substantially at right angles to a bifurcated foot portion 24. Wall section 22 has a series of resilient members 26 that are shaped as cutouts from wall section 22 and are sprung forward from the planar surface of the section, as best shown in FIG. 2. Section 22 includes aperture 28 that is substantially concentric with aperture 18 of shield 16. Foot portion 24 comprises two feet extensions which extend below connector 10 when assembled therewith and include cutout regions 32 for receiving lugs 20 of shield 16 when assembling these two components together onto a circuit board. Further, portion 24 includes upstanding resilient members that function to pressure engage against shield 16 when assembled therewith and provide good electrical contact to shield 16 as well as grip the sides of the shield when these two components are being assembled to a circuit board.

Figure 1A:
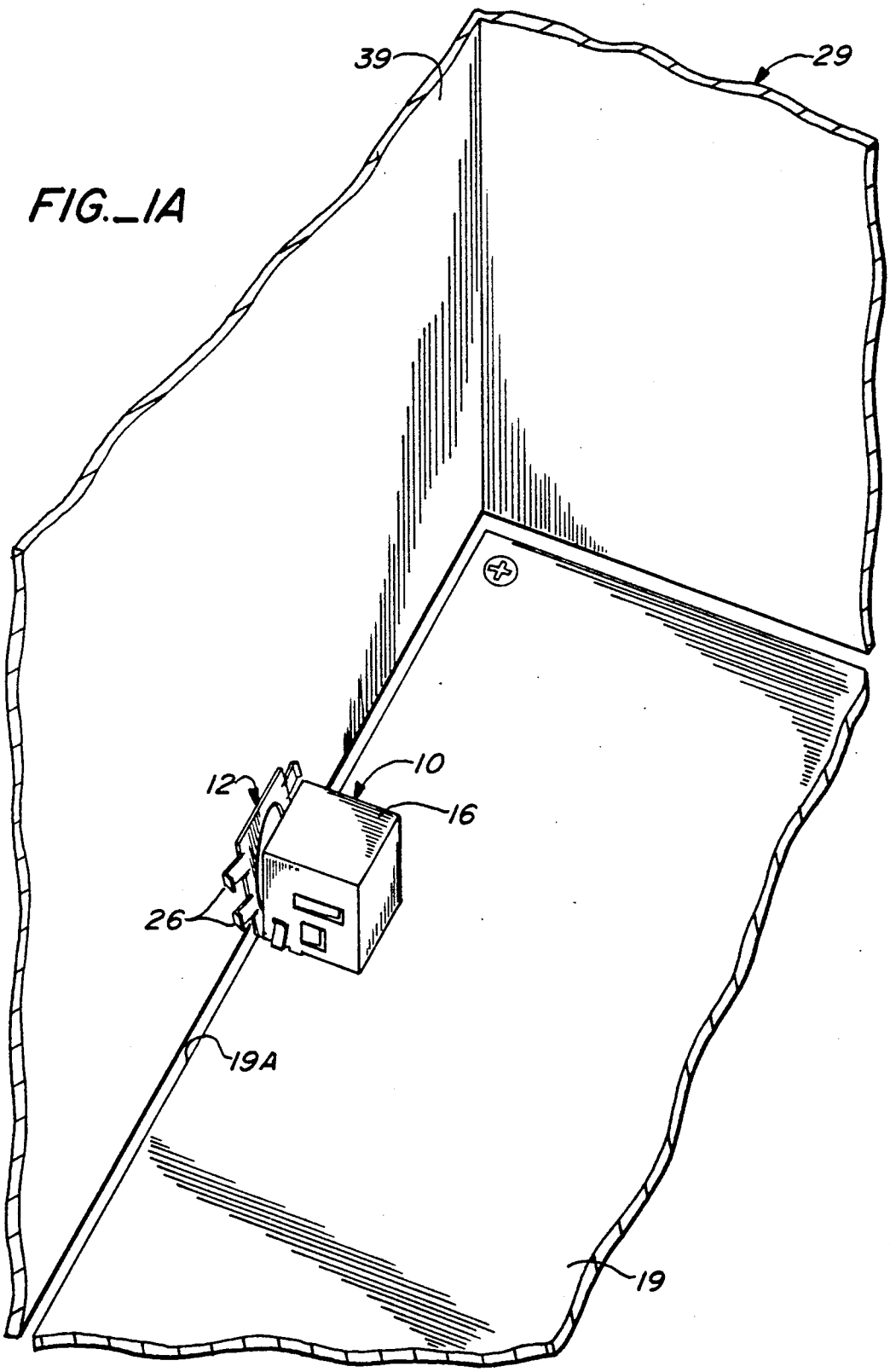
FIG. 1A is a perspective view of the miniature electrical circuit connector assembled to an edge of a circuit board.

Connector 10 is assembled to an edge of a circuit board 19 such as, the rear edge of a main circuit board or motherboard as shown in FIG. 1A. When the circuit board 19 is assembled into an electronic chassis 29 such as for a computer, the circuit board rear edge 19A is in close proximity to rear side wall or backplane 39. Under these circumstances, there is generally some spatial tolerance between the edge of the circuit board and the backplane. The backplane 39 in many cases represents a ground and EMI shield plane and, therefore, is conductive or metal. It is desirable that this ground plane be the same reference ground for shield 16. This requires an electrical connection between connector shield 16 and the ground reference backplane 39. As previously indicated, this connection presents a problem particularly when removing the circuit board 19 from the electronic chassis 29 since the ground connection between connector 10 and the backplane 39 must be first accomplished. Contact member 12 of this invention eliminates the need for a fastened connection between these grounded components since member 12 includes spring-like members 26 that take up the spatial tolerance between the backplane 39 and circuit board edge 19A and further are biased against the conductive surface of the backplane 39 when the circuit board is assembled into the electronic chassis 29. Thus, a substained and continuously assured electrical contact is maintained between the conductive backplane 39 and the ground of connector shield 16 as well as a circuit board ground as long as the circuit board 19 remains assembled in the electronic chassis 29.

It should be noted that the concepts of the resilient spring members 26 could also be integral components of shield 16, in particular, extending outwardly from the front face of the shield to engage the conductive backplane surface. Thus, it is not necessary relative to this invention that contact member 12 be a separate component but rather may be integral with shield 16, as exemplified later in connection with the embodiment shown in FIG. 7. The principal reason why contact member 12 is a separate component is that mini DIN connectors 10 are standard components available in the world market place and have been fairly standardized for circuit connection utility. Thus, they are relatively inexpensive and easily available to obtain at this time. Rather than have a manufacture change the standard configuration of shield 16, a separate component in the form of contact member 12 may be added to the assembly at very little added cost. However, the concept of this invention is achieved by either approach to have sustained electrical connection between shield ground and backplane ground by means of resilient spring means formed relative to connector 10 to be spring loaded against the backplane surface when a circuit board containing edge mini DIN connectors utilizing such resilient spring means is assembled into an electronic chassis.

Figure 4:
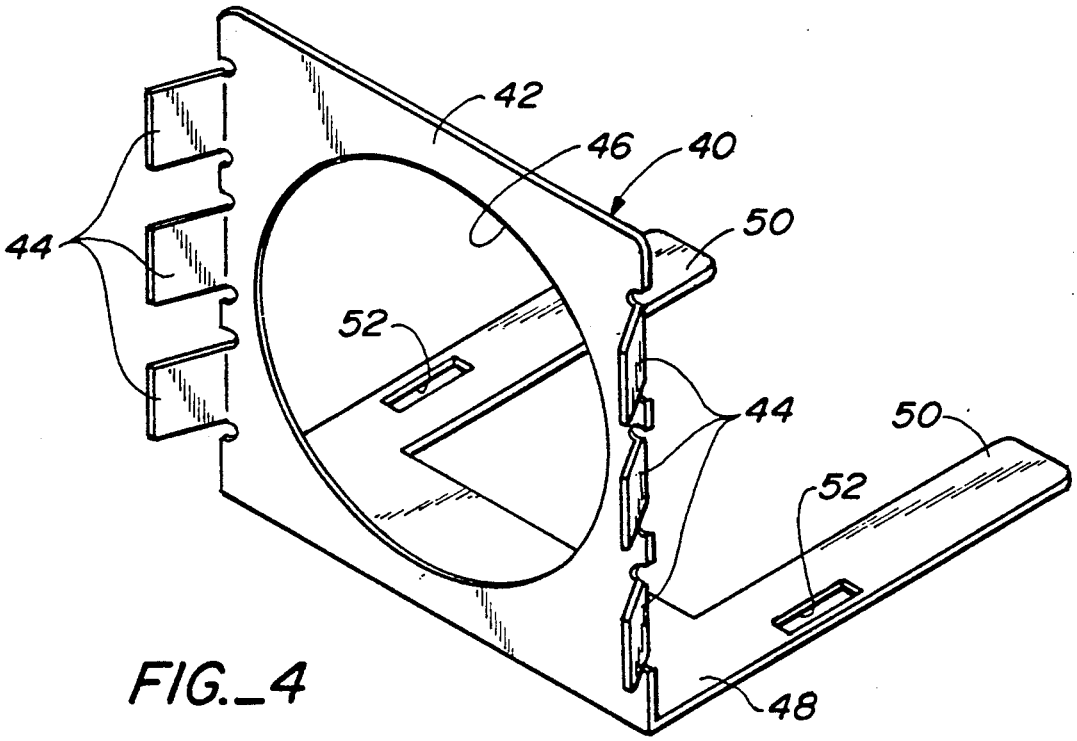
FIG. 4 is a perspective view of a second embodiment of a ground contact mount for a miniature electrical circuit connector comprising this invention.
Figure 5:
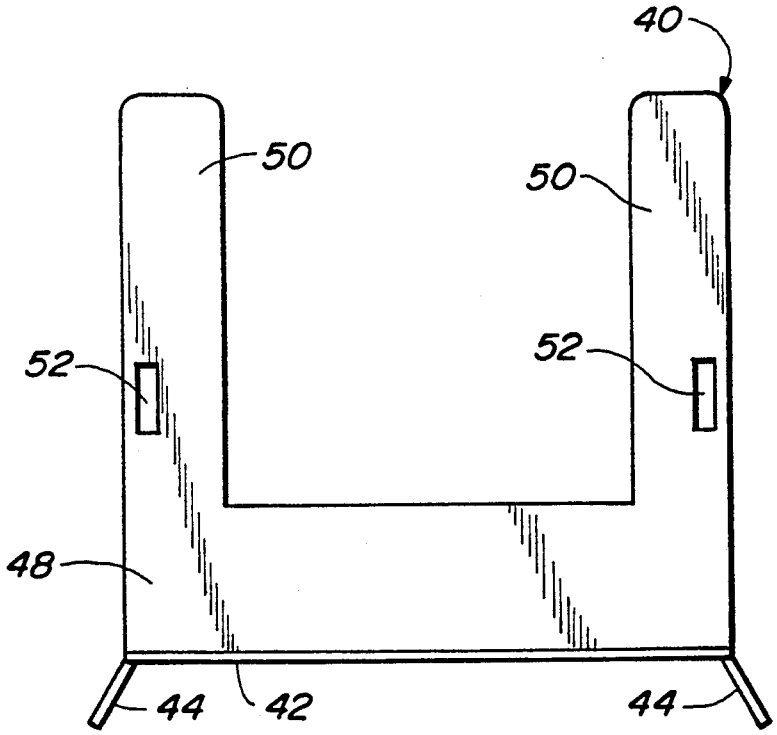
FIG. 5 is a top view of the ground contact mount of FIG. 4.
Figure 6:
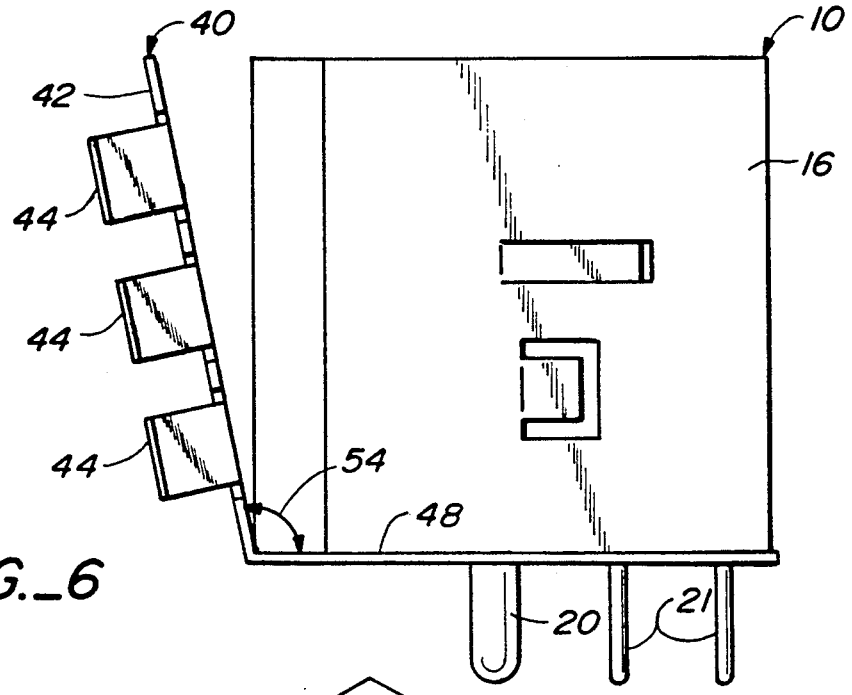
FIG. 6 is a side elevation of the ground contact mount of FIG. 4.

Reference is now made to FIGS. 4–6 wherein there is disclosed a second embodiment of this invention. Contact member 40 comprises upstanding wall section 42 and angularly disposed foot portion 48. Section 42 may be disposed at right angle with foot portion 48 or disposed at an obtuse angle 54, as indicated in FIG. 6 so that section 42 will be biased against the surface of the backplane when assembled in the electronic chassis. Contact member 40 is otherwise similar in construction contact member 12 having a series of outwardly disposed reilient spring-like members 44 in section 42 to engage the backplane surface. Aperture 46 is formed in section 42 in concentric relation to aperture 18 of connector shield 16. Foot portion 48 includes a pair of feet members 50 which extend beneath the body of mini DIN connector 10 to support contact member in a rigid upright manner when assembled with connector 10 to the circuit board. Foot portion 48 includes a pair of apertures 52 through which are received connection lugs 20 of connector shield 16 which are then connected to the circuit board. As shown in FIG. 6, connector 10 includes solder tails 21 of the connector terminals for connection to other circuit components on the circuit board.

Figure 7:
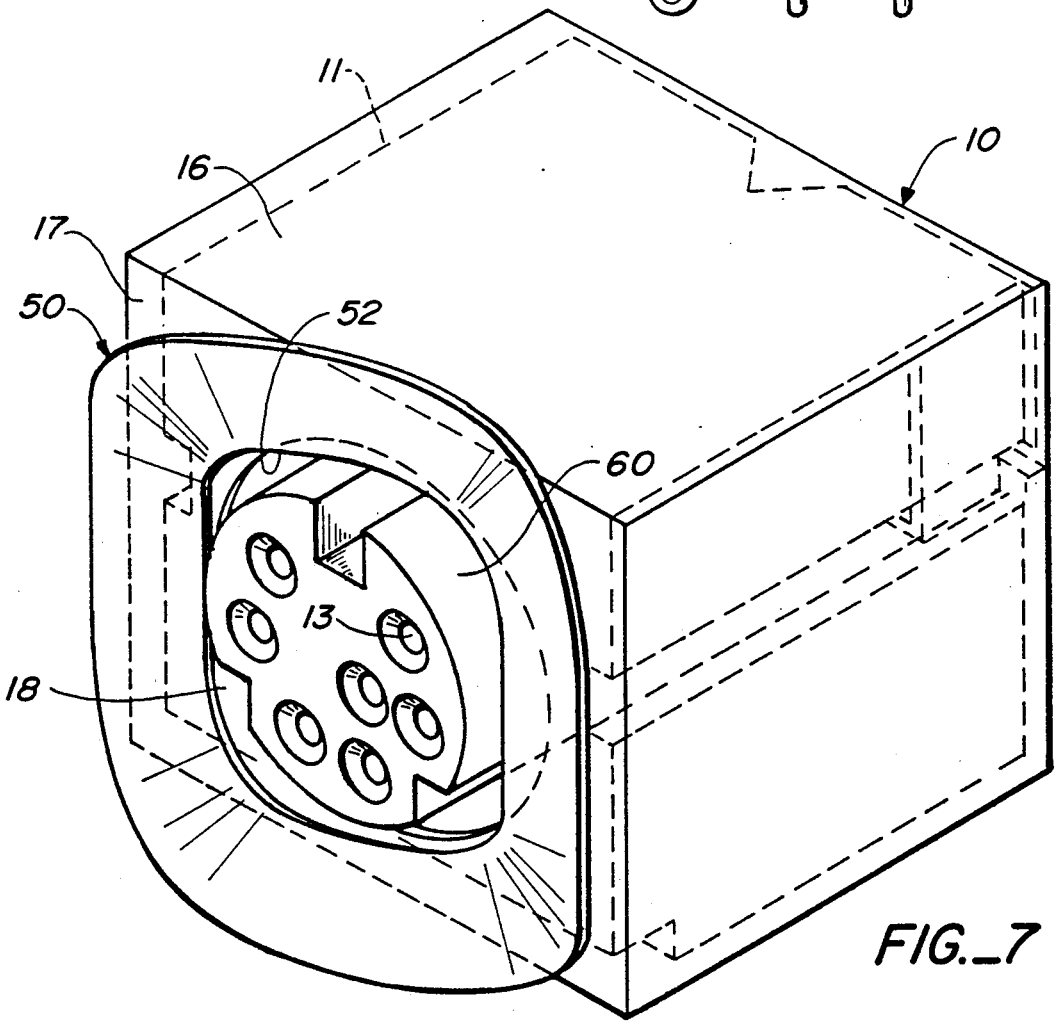
FIG. 7 is a perspective view of a third embodiment of a ground contact mount for a miniature electrical circuit connector comprising this invention.

Reference is now made to another embodiment of this invention shown in FIG. 7. Miniature electrical circuit connector 10 is provided with an extended barrel 60 for receptacle 14 which extends out from front face 17 for projection into or through a corresponding opening in the side wall or backplane of the electronic chassis. Contact member 50 may be a conductive wavy or spring washer having a central aperture 52 concentric with aperture 18 of shield front face 17. As another example, contact member 50 may be a conductive coil spring provided on extended barrel 60.

Member 50 may be mounted onto barrel 60 and may rest on this barrel extension in a self-aligning manner while brought into electrical contact between the conductive backplane and front face 17 of connector 10 when the circuit board, upon which connector 10 is mounted along one edge thereof, is installed into electronic chassis with the board edge at a spatial tolerance relative to the surface of the conductive backplane. Contact member 50 extends over this spatial tolerance and engages with spring-like force against both the backplane surface and front face surface 17 for sustained electrical ground connection.

Alternatively, contact member 50 in FIG. 7 may be an integral with or secured to front face 17 of connector shield 16 and comprise a wavy washer construction having a central aperture 52 concentric with aperture 18 of shield front face 17. Wavy washer or spring washer 50 is of resilient form for pressure engagement against the surface of the backplane to provide sustained electrical contact therewith when the circuit board, upon which connector 10 is mounted along one edge thereof, is installed in an electronic chassis with the board edge at a spatial tolerance relative to the surface of the backplane. Contact member 50 extends over this spatial tolerance and engages with spring-like force against the backplane surface for sustained electrical ground connection.

Figure 8:
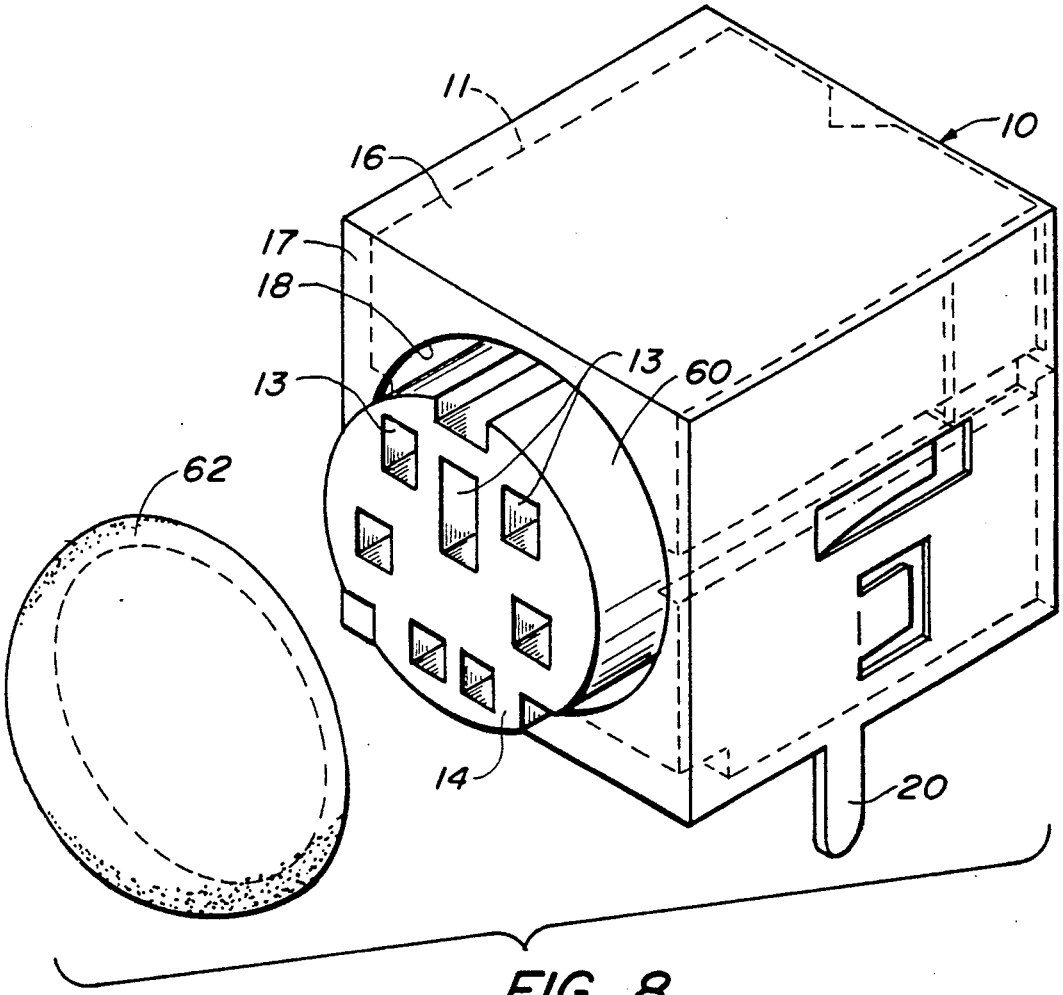
FIG. 8 is a perspective view of a miniature electrical circuit connector having an extended receptacle comprising this invention.
Figure 9:
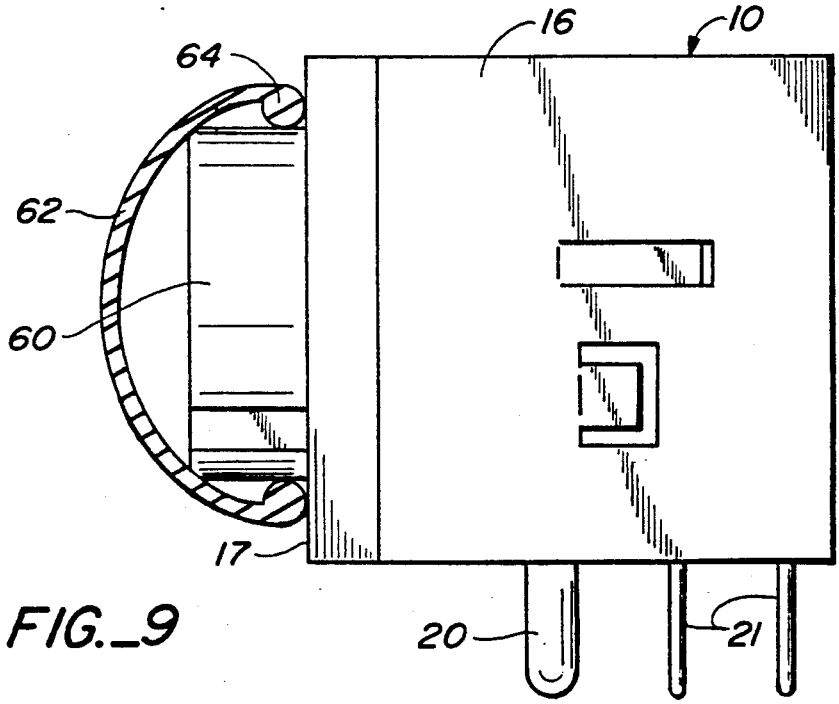
FIG. 9 is a side elevation of the miniature electrical circuit connector of FIG. 8 with an elastomeric cot or condom covering the extended receptacle of the connector.

Connector 10 in FIGS. 8 and 9 is similar to that shown in FIG. 7 wherein the connector receptacle is provided with an extended barrel 60. This extended barrel permits the more easy access of the plug to the receptacle 14 since the latter will extend through the backplane for easy access. Beside the utility of barrel 60 for the support of a self-aligned contact member 50, the extended barrel 60 also provides for receipt of an elastomeric cot or condom 62 over barrel 60 and held in position by means of cot or condom band 64. This seals receptacle 14 and protects the internal connector terminals from contamination and corrosion due to the application of solder fluxes, as well as solder bath and aqua wash baths, applied to the circuit board during its assembly and manufacture. Thus mini DIN connectors 10 with extended barrels can be easily installed to circuit boards prior to the application of solder fluxes followed by a solder bath and then a final aqua bath to rinse the board of flux residue and cot or condom 62 protects the internal terminals and terminal pins of connector 10 from contamination during such processing.

Since extended barrel 60 provides for additional EMI exposure, an annular shield can be provide over the barrel extension of receptacle 14 which may be an integral part of shield 16 or an extended shield part of annular shield 26 illustrated in U.S. Pat. No. 4,913,664. Further, the embodiments of FIGS. 4-6 and FIG. 7 can provide for effective shielding of extended barrel 60 since they substantially surround the, exterior of the barrel with conductive portions. Barrel 60 may be extended from the front face of body 11 by about $11\times10^{-3}$ of an inch, taking into consideration that the typical backplane wall may be about $4\times10^{-3}$ of an inch thick.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as may fall within the spirit and scope of the appended claims.

What is claimed is:

1. A miniature electrical circuit connector for mounting along an edge of an electrical circuit board which is mounted in an electrical chassis having at least one side wall, said connector having a body with a front face including an electrical receptacle, a conductive shield formed over a portion of said body including said front face with an aperture formed therein to permit exposure of said front face receptacle, resilient conductive contact means connected to said connector and having a resilient portion aligned in front of said body front face and supported so as to extend outwardly in front of said body front face, said resilient portion placed in biased engagement against said side wall, said resilient portion in aligned interposed relation between said connector body front face and said side wall to continuously maintain said aligned, biased engagement against said side wall when said circuit board is mounted into said electrical chassis.

2. The miniature electrical circuit connector of claim 1 wherein said resilient conductive contact means comprises a conductive contact member extending from the front face of said connector and formed as a bias member to pressure engage against said side wall when said circuit board is mounted into said electrical chassis.

3. The miniature electrical circuit connector of claim 1 wherein said resilient conductive contact means comprises a conductive contact member connected to said connector and having a wall surface extending in front of said front face, an aperture formed in said contact member substantially aligned with said shield aperture, resilient means formed on said contact member to pressure engage against said side wall when said circuit board is mounted into said electrical chassis.

4. A miniature electrical circuit connector for mounting along an edge of an electrical circuit board which is mounted in an electrical chassis having at least one side wall, said connector having a body with a front face including an electrical receptacle, a conductive shield formed over a portion of said body including said front face with an aperture formed therein to permit exposure of said front face receptacle, resilient conductive contact means connected to said connector with a portion thereof formed outwardly relative to said body front face, said resilient conductive contact means placed in biased engagement against said side wall when said circuit board is mounted into said electrical chassis, said conductive contact member comprises an upstanding wall surface connected to a bifurcated foot portion at substantially orthogonal relationship, said conductive shield having downwardly extending connection lugs for mounting said connector to said circuit board and permitting said conductive shield to be grounded to said board, means on said bifurcated foot portion to receive said shield connection lugs and secure said contact member between said connector and said circuit board when said connection lugs are mounted to said circuit board.

5. The miniature electrical circuit connector of claim 4 wherein said bifurcated foot portion receiving means comprises apertures formed in said bifurcated foot portion to receive said connection lugs.

6. The miniature electrical circuit connector of claim 4 wherein said bifurcated foot portion receiving means comprises cutout portions formed on opposite edges of said bifurcated foot portion to receive said connection lugs, resilient spring members formed from said bifurcated foot portion for pressure engaging said connector shield formed on side surfaces of said body when said connection lugs are mounted to said circuit board.

7. The miniature electrical circuit connector of claim 1 wherein said resilient conductive contact means comprises a conductive contact member connected to said connector and having a surface extending in front of said front face, an aperture formed in said contact member substantially aligned with said shield aperture, resilient means formed on said contact member to pressure engage against said side wall when said circuit board is mounted into said electrical chassis.

8. The miniature electrical circuit connector of claim 1 wherein said resilient conductive contact means comprises a conductive contact member extending from the front face of said connector in form of a conductive wavy or spring washer to function as a bias member to pressure engage against said side wall when said circuit board is mounted into said electrical chassis.

9. The miniature electrical circuit connector of claim 1 wherein said resilient conductive contact means comprises a conductive contact member extending from the front face of said connector in form of a conductive spring member to function as a bias member to pressure engage against said side wall when said circuit board is mounted into said electrical chassis.

10. The miniature electrical circuit connector of any one of claims 1 through 9 wherein said receptacle has a barrel portion extending from the surface of said connector front face and protruding into an opening in said side wall, said resilient conductive contact means mounted relative to said barrel portion.

11. The miniature electrical circuit connector of claim 10 wherein an elastomeric cot is provided over said receptacle extended barrel portion when said miniature electrical circuit connector is mounted to said electrical board, said cot protecting said receptacle from solder flux and solder splash when said electrical board is subjected to a solder bath.

12. A conductive contact member for use in conjunction with a miniature electrical circuit connector, said connector having a substantially rectangular shaped body with a front face, a receptacle formed on said front face, a conductive shield formed around each of the side and top surfaces of said body with a first aperture formed in a front side surface of said shield to permit access to said receptacle therethrough, said conductive contact member connected to said miniature electrical circuit connector and having a surface extending outwardly in direct alignment with and in front of said front side surface, a second aperture formed in said contact member substantially aligned with said first aperture, resilient means formed on said contact member functioning as pressure engagement means when said miniature electrical circuit connector is mounted along an edge of a circuit board with said board edge positioned adjacent to a wall member of an electrical chassis wherein said resilient means is placed in biased engagement against said wall member and in aligned interposed relation between said connector front side surface and said wall member to continuously maintain said aligned, biased engagement against said wall member.

13. A conductive contact member for use in conjunction with a miniature electrical circuit connector, said connector having a substantially rectangular shaped body with a front face, a receptacle formed on said front face, a conductive shield formed around each of the side and top surfaces of said body with a first aperture formed in a front side surface of said shield to permit access to said receptacle therethrough, a conductive contact member connected to said miniature electrical circuit connector and having a surface extending in front of said front side surface, a second aperture formed in said contact member substantially aligned with said first aperture, resilient means formed on said contact member to pressure engage against a side wall when said miniature electrical circuit connector is mounted along an edge of a circuit board mounted at a substantially right angle relative to said side wall with said board edge positioned adjacent to said side wall, comprising an upstanding wall surface connected to a pair of spatially disposed, bifurcated feet extending from said wall surface at substantially right angle relationship, said conductive shield having a pair of downwardly extending connection lugs for mounting said connector to said circuit board and permitting said conductive shield to be grounded to said board, means on each of said bifurcated feet to receive said shield connection lugs and secure said contact member between said connector and said circuit board when said connection lugs are mounted to said circuit board.

14. The conductive contact member of claim 13 wherein said bifurcated feet receiving means comprise an aperture formed in each of said bifurcated feef to respectively receive said connection lugs.

15. The conductive contact member of claim 13 wherein said bifurcated feet receiving means comprises cutout edge portions formed on opposite edges of said bifurcated feet to receive said connection lugs, upwardly extending, resilient spring members formed on said bifurcated feet for pressure engaging said connector shield side surfaces when said connection lugs are mounted to said circuit board.

16. The conductive contact member of claim 12 wherein said receptacle is a barrel portion extending from the surface of said front face protruding through an opening in said side wall.

17. The conductive contact member of claim 16 wherein a elastomeric cot is provided over said receptacle extended barrel portion when said miniature electrical circuit connector is mounted to said electrical board, said cot protecting said receptacle from solder flux and solder splash when said electrical board is subjected to a solder bath.

18. A contact member for use in conjunction with a miniature electrical circuit connector comprising a substantially nonconductive, rectangular body with a front face including a receptacle for a mating plug member and a bottom with depending electrical connector lugs electrically coupled to terminals in said receptacle and extending downwardly from said body, a metal shield surrounding a portion of said body including the opposite side surfaces thereof, depending legs extending downward from side surfaces of said shield, said lugs and legs for surface mounting of said assembled connector on a board having a surface extending in a first plane with exposure of said front face through an aperture formed in a backplane extending in a second plane when said mounted connector and backplane are assembled in a chassis, the ground contact member comprising:

a conductive contact member positioned in said second plane in direct alignment between said connector front face and said backplane having outwardly extended conductive engaging means for biased engagement with said backplane, said outwardly extended conductive engaging means in aligned interposed relation between said connector front face and said backplane to continuously maintain said aligned, biased engagement against said backplane when said mounted connector is assembled in said chassis, said contact member having an aperture concentric with said body receptacle.

19. The contact member of claim 18 wherein said conductive engaging means are formed spring members on the front face of said conductive contact member.

20. The contact member of claim 18 wherein said conductive contact member includes a pair of outwardly extending legs in said first plane, means formed relative to said legs to engage and support said conductive contact member on said connector.

21. A contact member for use in conjunction with a miniature electrical circuit connector comprising a substantially nonconductive, rectangular body with a front face including a receptacle for a mating plug member and a bottom with depending electrical connector lugs electrically coupled to terminals in said receptacle and extending downwardly from said body, a metal shield surrounding a portion of said body including the opposite side surfaces thereof, depending legs extending downward from side surfaces of said shield, said lugs and legs for surface mounting of said assembled connector on a board having a surface extending in a first plane with exposure of said front face through an aperture formed in a backplane extending in a second plane when said mounted connector and backplane are assembled in a chassis, the ground contact member comprising:

a conductive contact member positioned in said second plane in for alignment with said connector front face having outwardly extended conductive engaging means for biased engagement with said backplane when said mounted connector is assembled in said chassis, said contact member having an aperture concentric with said body receptacle, said conductive contact member includes a pair of outwardly extending legs in said first plane, means formed relative to said legs to engage and support said conductive contact member on said connector, said leg formed means comprises an aperture formed in each leg into which each of said metal shield legs are inserted.

22. The contact member of claim 21 wherein said leg formed means further comprises at least one spring member formed on each of said legs for engagement of said shield side surfaces when said member leg apertures are inserted onto said metal shield legs.

23. The contact member of claim 20 wherein said leg formed means comprises an aperture formed in each leg into which each of said metal shield legs are inserted.

24. The contact member of claim 23 wherein said leg formed means further comprises at least one spring member formed on each of said legs for engagement of said shield side surfaces when said member leg apertures are inserted onto said metal shield legs.

* * * * *